United States Patent [19]

Kitada et al.

[11] Patent Number: 4,943,727

[45] Date of Patent: Jul. 24, 1990

[54] RADIOGRAPHIC INTENSIFYING SCREEN

[75] Inventors: Akira Kitada, Odawara; Kikuo Yamazaki; Terumi Matsuda, both of Minami-ashigara; Jun Kawagoe, Fujinomiya, all of Japan

[73] Assignee: Fuji Photo Film Co., Ltd., Kanagawa, Japan

[21] Appl. No.: 146,694

[22] Filed: Jan. 21, 1988

[30] Foreign Application Priority Data

Jan. 21, 1987 [JP] Japan ..... 62-11902

[51] Int. Cl.[5] ..... G21K 4/00

[52] U.S. Cl. ..... 250/483.1; 250/484.1

[58] Field of Search ..... 250/483.1, 484.1 R

[56] References Cited

U.S. PATENT DOCUMENTS 3,870,892 3/1975 Fass et al. ..... 250/483.1
4,032,791 6/1977 Chiola et al. ..... 250/483.1
4,090,085 5/1978 Shimiya et al. ..... 250/483.1
4,666,774 5/1987 Christini ..... 250/483.1
4,704,538 11/1987 Kitada ..... 250/483.1
4,711,827 12/1987 Christini ..... 250/483.1

FOREIGN PATENT DOCUMENTS 2175129 11/1986 United Kingdom ..... 250/483.1

*Primary Examiner*—Constantine Hannaher
*Assistant Examiner*—J. Eisenberg
*Attorney, Agent, or Firm*—Sixbey, Friedman, Leedom & Ferguson

[57] ABSTRACT

An improvement of a radiographic intensifying screen comprising a support, a phosphor layer which comprises a binder and a phosphor dispersed therein and a protective film, superposed in order, comprises a metal film on one or both surfaces of said protective film.

7 Claims, 1 Drawing Sheet

RADIOGRAPHIC INTENSIFYING SCREEN

BACKGROUND OF THE INVENTION

1. Field of the Invention

The present invention relates to a radiographic intensifying screen, and more particularly to a radiographic intensifying screen which is improved in the antistatic properties.

2. Description of the Prior Art

In various kinds of radiography such as medical radiography for diagnosis and industrial radiography for nondestructive inpsection, a radiographic intensifying screen is generally employed in close contact with one or both surfaces of a radiographic film such as an X-ray film to enhance a radiographic speed of the radiography.

The radiographic intensifying screen basically comprises a support and a phosphor layer provided on one surface of the support. A transparent film made of a plastic material is generally provided on a free surface of the phosphor layer (surface not facing the support) to keep the phosphor layer from chemical and physical deterioration.

The phosphor layer comprises a binder and phosphor particles dispersed therein. The phosphor particles emit a light of high luminance when excited with a radiation such as X-rays. Accordingly, the phosphor particles give light emission of high luminance in proportion to the dose of the radiation having passed through an object, and the radiographic film placed in close contact with the phosphor layer of the screen can be sufficiently sensitized by the emitted light to form a radiation image of the object thereon, even if the radiation is applied to the object at a relatively small dose.

In a practical use of the radiographic intensifying screen in the radiography, a pair of screens are combined with a radiographic film in a cassette in such a manner that the screens are brought into close contact with both surfaces of the radiographic film. Since the cassette is light-blocking, the radiographic film can be prevented from being exposed to a light even in a light room, and the screen can be readily brought into close contact with the radiographic film.

However, since both of the screen and the film are made of plastic materials, an electrostatic charge is liable to occur by rubbing of the screen with the film when the film is inserted into or taken out of the cassette, and thereby the surfaces of the screen and the film are easily electrified to give an electrostatic discharge between the screen and the film. Because of the electrostatic discharge, the radiographic film is sensitized and the resulting image on the developed film suffers a noise (i.e., static mark) to reduce the precision in the medical diagnosis.

Recently, a continuous radiographic system not using a cassette (cassette-less sytem) has been developed and is now practically utilized for enhancing the radiographic speed. For example, in a radiographic apparatus for blood vessel (i.e., AOT system), a pair of radiographic intensifying screens are fixed in the predetemined position, and a number of radiographic films are set in a magazine. For conducting the radiographic operation, the radiographic films having been set in the magazine are automatically and continuously transferred and inserted between the two screens one after another. The used film is then transferred and received in other magazine for used films, and at the same time other unused film is inserted between the screens.

In the above-mentioned cassette-less system, the radiographic film is liable to be much more charged than the case of using a cassette. That is, the film easily electrified by the static charge caused by rubbing with another film when the film is taken out of the magazine or rubbing with transferring members in the transferring procedure, as well as the contact with the screens.

For preventing the occurrence of the static electrification of the radiographic film, various measures have been proposed and utilized. For example, a method of coating or spraying a liquid antistatic agent (e.g., commercially available Antistatic cleaner) onto a radiographic intensifying screen is generally carried out to reduce electrification of the film. However, this method only forms a coated layer of the antistatic agent on the surface of the screen, so that the coated layer tends to gradually separate from the screen with time after repeated contact with the radiographic film, etc., and hence the screen is hardly used for a long period of time. Especially in a high-speed radiographic system involving a number of radiographic operations and repeated usage of the screen, there occurs such necessity that the antistatic treatment (coating or spraying the antistatic agent) should be repeatedly done at appropriate intervals.

As other measures for preventing electrification, a method of imntroducing antistatic property into a radiographic intensifying screen per se has been proposed. For example, a carbon black layer is provided between the support and the phosphor layer and an antistatic agent is incorporated into the protective film, as disclosed in U.S. Pat. No. 4,090,085 to Shimiya et al.

SUMMARY OF THE INVENTION

It is an object of the present invention to provide a radiographic intensifying screen capable of preventing static dsicharge phenomenon occurring between the screen and a radiographic film.

It is another object of the invention to provide a radiographic intensifying screen which is improved in the antistatic properties without lowering the quality of an image provided thereby.

There is provided by the invention a radiographic intensifying screen comprising a support, a phosphor layer which comprises a binder and a phosphor dispersed therein and a protective film, superposed in order, in which a metal film is provided on one or both surfaces of said protective film.

According to the present invention, a metal thin film is provided on the phosphor layer side-surface of the protective film (surface facing the phosphor layer) and/or the opposite side surface, whereby the surface of the screen (protective film side-surface of the screen) can be prevented from being electrostatically charged.

In more detail, since the metal film is provided on one or both surfaces of the protective film, the static charge generating by the contact between the screen and the film is not deposited on the surface of the screen, and the electrification of the screen surface can be constantly kept at a low level. Hence, the occurrence of discharge phenomenon between the screen and the film can be effectively reduced, and accordingly static marks can be effectively prevented from occurring on the developed film to give an image of high quality.

The metal film provided on the protective film has a chromatic color (so-called "metallic color"), and the metal film shows absorption characteristics for a light having the emission wavelength region of the phosphor contained in the radiographic intensifying screen. Accordingly, the screen of the invention can provide an image of almost the same quality (e.g., sharpness and graininess) and show almost the same level of radiographic speed as those of a conventional colored intensifying screen which provides an image of high quality and shows a high radiographic speed. Further, the screen of the invention can provide an image of much more improved sharpness and graininess by appropriately varying the thickness of the metal film to control the apparent color degree of the protective film.

BRIEF DESCRIPTION OF THE DRAWING

Each of FIG. 1

DETAILED DESCRIPTION OF THE INVENTION

Representative embodiments of the radiographic intensifying screen according to the invention are described hereinafter referring to FIG. 1 and FIG. 2.

Figure 1:
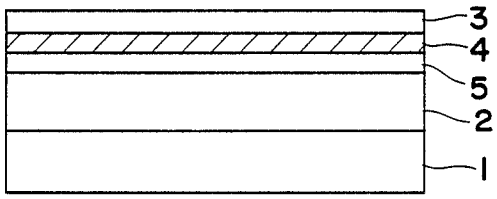
Figure 2:
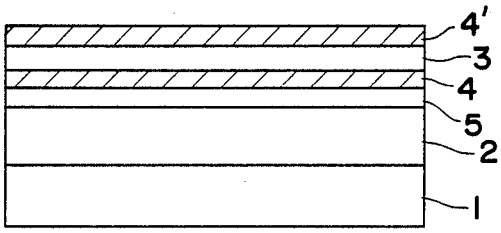
FIG. 2 is a sectional view illustrating an example of a radiographic intensifying screen according to the present invention.

FIGS. 1 and 2 are sectional views showing a radiographic intensifying screen comprising a metal film provided on one surface of a protective film and a radiographic intensifying screen comprising metal films provided on both surfaces of a protective film, repsectively.

In FIG. 1, the screen comprises a support 1, a phosphor layer 2 and a protective film 3, and a metal layer 4 is provided on the phosphor layer side-surface of the protective film. The phosphor layer 2 is combined with the protective film 3 via an adhesive layer 5.

In FIG. 2, the screen comprises a support 1, a phosphor layer 2 and a protective film 3, and metal layers 4, 4' are provided on both surfaces of the protective film. The phosphor layer 2 is combined with the protective film 3 via an adhesive layer 5.

The radiographic intensifying screen of the invention is by no means restricted to above-mentioned embodiments, and any other embodiment can be also applied to the invention, as far as the metal film is provided on at least one surface of the protective film. For example, the metal film may be provided on the support side-surface (surface not facing the phosphor layer) of the protective film. Otherwise, a variety of additional layers such as a light-reflecting layer and a light-absorbing layer may be provided between the support and the phosphor layer.

The radiographic intensifying screen of the invention can be prepared, for example, by the following process.

The support material employed in the present invention can be selected from those employed in the conventional radiograpic intensifying screens. Examples of the support materials include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. A plastic film is preferably used as the support material from the viewpoints of various properties required for radiographic intensifying screens. The plastic film may contain a light-absorbing material such as carbon black, or may contain a light-reflecting material such as titanium dioxide. The former is appropriate for preparing a high-sharpness type radiographic intensifying screen, while the latter is appropriate for preparing a high-speed type radiographic intensifying screen.

In the conventional screens, one or more additional layers may be provided on the surface of the support to enhance the bonding strength between the support and a phosphor layer to be coated thereon, or to improve the radiographic speed of the screen or the quality of an image provided thereby. For example, a subbing layer or an adhesive layer is provided by coating a polymer material such as gelatin over the phosphor layer side-surface of the support. Otherwise, a light-reflecting layer or a light-absorbing layer may be provided by forming a polymer material layer containing a light-reflecting material such as titanium dioxide or a light-absorbing material such as carbon black. Such additional layers can be also provided on the support of the screen of the present invention.

As described in U.S. Pat. No. 4,575,635, the phosphor layer side-surface of the support (or the surface of an adhesive layer, a light-reflecting layer, and a light-absorbing layer in the case that such layers are provided on the support) may be provided with protruded and depressed portions for the enhancement of the sharpness of an image.

On the support is then provided a phosphor layer.

The phosphor layer comprises a binder and phosphor particles dispersed therein.

A variety of phosphors are already known. Preferred are phosphors which emit a light within the wavelength region of near ultraviolet to visible rays (i.e., blue, green and red region).

Examples of such phosphors include:

tungstate phosphors such as $CaWO_4$, $MgWO_4$ and $CaWO_4$:Pb;

terbium activated rare earth oxysulfide phosphors such as $Y_2O_2S$:Tb, $Gd_2O_2S$:Tb, $La_2O_2S$:Tb, $(Y,Gd)_2O_2S$:Tb and $(Y,Gd)_2O_2S$:TB,Tm;

terbium activated phosphate phosphors such as $YPO_4$:Tb, $GdPO_4$:Tb and $LaPO_4$:Tb;

terbium activated rare earth oxyhalide phosphors such as LaOBr:Tb, LaOBr:Tb,Tm, LaOCl:Tb, LaOCl:Tb,Tm, GdOBr:Tb and GdOCl:Tb;

thulium activated rare earth oxyhalide phosphors such as LaOBr:Tm and LaOCl:Tm;

barium sulfate phosphors such as $BaSO_4$:Pb, $BaSO_4$:$Eu^{2+}$ and $(Ba,Sr)SO_4$:$Eu^{2+}$;

divalent europium activated alkaline earth metal phosphate phosphors such as $Ba_3(PO_4)_2$:$Eu^{2+}$ and $(Ba,Sr)_3(PO_4)_2$:$Eu^{2+}$;

divalent europium activated alkaline earth metal fluorohalide phosphors such as BaFCl:$Eu^{2+}$, BaFBr:$Eu^{2+}$, BaFCl:$Eu^{2+}$,Tb, BaFBr:$Eu^{2+}$,Tb, $BaF_2$.$BaCl_2$.KCl:$Eu^{2+}$, $BaF_2$.$BaCl_2$.x$BaSO_4$.KCl:$Eu^{2+}$ and $(Ba,Mg)F_2$.$BaCl_2$.KCl:$Eu^{2+}$;

iodide phosphors such as CsI:Na, CsI:Tl, NaI and Ki:Tl;

sulfide phosphors such as ZnS:Ag, (Zn,Cd)S:Ag, (Zn,Cd)S:Cu, (Zn,Cd)S:Cu and Al;

hafnium phosphate phosphrs such as $HfP_2O_7$:Cu;

europium activated rare earth oxysulfide phosphors such as $Y_2O_2S$:Eu, $Gd_2O_2S$:Eu, $La_2O_2S$:Eu and $(Y,Gd)_2O_2S$:Eu;

europium activated rare earth oxide phosphors such as $Y_2O_3$:Eu, $Gd_2O_3$:Eu, $La_2O_3$:Eu and $(Y,Gd)_2O_3$:Eu;

europium activated rare earth phosphate phosphors such as $YPO_4$:Eu, $GdPO_4$:Eu and $LaPO_4$:Eu and europium activated rare earth vanadate phosphors such as $YVO_4$:Eu, $GdVO_4$: Eu, $LaVO_4$:Eu and (Y,Gd-)$VO_4$:Eu.

The above-described phosphors are given by no means to restrict the phosphor employable in the present invention. Any other phosphors can be also employed, provided that the phosphor emits light within the near ultraviolet to visible region when exposed to a radiation.

Examples of the binders employable for the preparation of the phosphor layer include natural polymers such as proteins (e.g., gelatin), polysaccharides (e.g., dextran) and gum arabic; and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate butyrate, polyvinyl alcohol and linear polyester. Particularly preferred are nitrocellulose, linear polyester, polyalkyl (meth)acrylate, a mixture of nitrocellulose and linear polyester, and a mixture of nitrocellulose and polyalkyl (meth)acrylate.

The phospshor layer can be formed on the support, for example, in the following manner.

In the first place, the above-mentioned phosphor and binder are added to an appropriate solvent, and they are well mixed to prepare a homogeneous coating dispersion of phosphor particles in a binder solution.

Examples of the solvents employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The mixing ratio between the binder and the phosphor in the coating dispersion may be determined according to the characteristics of the aimed radiographic intensifying screen and the nature of the employed phosphor. Generally, the ratio therebetween is within the range of from 1:1 to 1:100 (binder:phosphor, by weight), preferably from 1:8 to 1:40.

The coating dispersion may contain a dispersing agent to assist the dispersibility of the phosphor particles therein, and also contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion prepared as above is evenly applied onto the surface of the support to form a coated layer of the dispersion. The coating procedure can be carried out by a conventional method such as a method using a doctor blade, a roll coater or a knife coater. Then, the coated layer is slowly heated to dryness so as to complete the formation of a phosphor layer on the support. The thickness of the phosphor layer varies depending upon the characteristics of the aimed radiographic intensifying screen, the nature of the phosphor, the ratio between the binder and the phosphor, etc. Generally, the thickness thereof is in the range of 20 μm to 1 mm, preferably in the range of 50 to 500 μm.

The phosphor layer can be provided onto the support by the methods other than that given in the above. For instance, the phosphor layer is initially prepared on a sheet (false support) such as a glass plate, metal plate or plastic sheet using the aforementioned coating dispersion and then thus prepared phosphor layer is superposed on the genuine support by pressing or using an adhesive agent.

Subsequently, on the free surface of the phosphor layer (surface not facing the support) is provided a protective film having a metal film or metal layer which is a characteristic requisite of the invention.

Examples of materials of the metal film include metals such as Ni, Cr, Au, Sn, Al, Cu and Zn. Those metals may be employed alone or in combination (e.g., alloys or mixtures of two or more those metals).

The metal film can be formed on a surface of a protective film, for example, by a deposition method such as a vacuum deposition using the above-mentioned metal. As shown in FIG. 1 or 2, the metal film may be provided on only one surface of the protective film, or may be provided on both surfaces of the protective film. The thickness of the metal film varies depending on the nature of the metal, characteristics of the aimed radiographic intensifying screen, etc. Generally, the thickness thereof is in the range of approx. 10 to 1,000 angstroms, preferably in the range of 50 to 500 angstroms.

From the viewpoint of the antistatic properties, the surface resistivity of the metal film is preferably not more than $10^{12}$ ohm, more preferably not more than $10^8$ olm. From the viewpoint of the image quality, the light transmittance of the metal film is preferably in the range of 10 to 90%, more preferably in the range of 30 to 90%, at the peak wavelength of the emission of the phosphor employed.

As the material of the protective film, there can be mentioned transparent thin films which have been beforehand formed from polyethylene terephthalate, polyethylene, vinylidene chloride, polyamide and the like. Particularly preferred is a polyethylene terephthalate film from the viewpoints of hardness, transparency, etc. The transparent protective film preferably has thickness ranging from approx. 1 to 30 μm.

The protective film having the metal film thereon is provided on the surface of the phosphor layer, for example, by combining the protective film with the phosphor layer using an appropriate adhesive. In the case that the metal film is provided on only one surface of the protective film, the metal film is preferably arranged on the phosphor layer side (see: FIG. 1).

The present invention will be further illustrated by the following examples, but these examples by no means restrict the invention.

EXAMPLE 1

To a mixture of 1,600 parts by weight of divalent europium activated barium fluorobromide (BaFBr:$Eu^{2+}$) phosphor particles and 80 parts by weight of a linear polyester (Byron #500, available from Toyobo Co., Ltd.) was added methyl ethyl ketone. Then, to the mixture were successively added 15 parts by weight of nitrocellulose (nitration degree: 11.5%) and 5 parts by weight of isocyanate (Sumidule N-75, available from Sumitomo Bayer Urethane Co., Ltd.). The mixture was sufficiently stirred by means of a propeller agitator to obtain a homogeneous coating dispersion having a mixing ratio between the binder and the phosphor of 1:16 (by weight) and a viscosity of 25-35 PS (at 25° C.).

The coating dispersion obtained as above was evenly applied to a polyethylene terephthalate sheet containing carbon black (support, thickness: 250 μm) placed horizontally on a glass plate. The application of the coating dispersion was carried out using a doctor blade. The support having the coated layer of the dispersion was then placed in an oven and heated to dryness at a temperature gradually rising from 25° to 100° C. Thus, a phosphor layer having thickness of 200 μm was formed on the support.

A transparent polyethylene terephthalate film having a Ni-Cr deposited film on one surface (thicknes of polyethylene terephthalate film: 12 μm, thickness of Ni-Cr deposited film: approx. 150 angstroms, log SR: 4.57, light transmittance at the peak wavelength of emission of $BaFBr:Eu^{2+}$ phosphor: 40%, available from Toyo Metallizing Co., Ltd.) was provided with a polyester adhesive layer (thicknes: 1.5 μm) on the Ni-Cr deposited film side. The polyethylene terephthalate film was then combined with the phosphor layer through the adhesive layer.

Thus, a radiographic intensifying screen consisting of a support, a phosphor layer, an adhesive layer, a metal film (i.e., Ni-Cr deposited film) and a protective film, superposed in this order, was prepared, as shown in FIG. 1.

COMPARISON EXAMPLE 1

The procedure of Example 1 was repeated except that the polyethylene terephthalate film having a Ni-Cr deposited film was replaced with a simple polyethylene terephthalate film and that the phosphor layer was combined with the polyethylene terephthalate film using an adhesive containing a colorant (oil yellow 3 G, available from Orient Chemical Industries Co., Ltd.) in an amount of 1.52 g. per 100 g. of a solid content of the adhesive, to prepare a radiographic intensifying screen consisting of a support, a phosphor layer, a colored adhesive layer and a protective film.

The colorant used in Comparison Example 1 shows the peak of absorption at the peak wavelength of the emission of $BaFBr:Eu^{2+}$ phosphor and absorbs the light emitted by the phosphor, but vary neither the peak of the emission nor the shape of the emission spectrum.

The radiographic intensifying screens obtained in Example 1 and Comparison Example 1 were evaluated on the antistatic properties, the radiographic speed and482e sharpness and graininess of an image provided thereby according to the following tests.

(1) Antistatic properties

The radiographic intensifying screen was placed in a cassette, and then a commercial radiographic film having been subjected to an antistatic treatment was repeatedly inserted and taken out of the cassette to rub the surface of the screen with the film at many as 30 times of round trips.

Subsequently, the screen and a radiographic film (NEW RX-H, available from Fuji Photo Film Co., Ltd.) were placed in close contact with each other in a cassette. In five minutes, the radiographic film was taken out of the cassette and subjected to a developing treatment.

The antistatic properties of the screen was evaluated by observing occurrence of a static mark on the film through eye judgment. The results are classified into the following:

A: no static mark was observed;

B: some static marks were observed; and

C: a great number of static marks were observed.

(2) Radiographic speed

The radiographic intensifying screen and a radiographic film (NEW RX-H, available from Fuji Photo Film Co., Ltd.) were combined therewith in a cassette, and the radiographic film was exposed to X-rays at a voltage of 80 KVp. After the exposure to X-rays, the radiographic film was developed to obtain a visible image. The radiographic speed of the screen was measured based on the density of the visible image on the film. The radiographic speed was expressed by a relative value based on a radiographic speed of a commerically available intensifying screen (FS Screen of Kasei Optonics Co., Ltd.) being 100.

(3) Sharpness of image

The radiographic intensifying screen and a radiographic film (NEW RX-H, available from Fuji Photo Film Co., Ltd.) were combined therewith in a cassette, and the radiographic film was exposed to X-rays at a voltage of 80 KVp through a resolution chart. The radiographic film was then developed to obtain a visible image, and the contrast transfer function (CTF) value of the visible image was determined. The CTF value was given as a value at the spatial frequency of 2 cycle/mm.

(4) Graininess of image

The radiographic intensifying screen and a radiographic film (NEW RX-H, available from Fuji Photo Film Co., Ltd.) were combined therewith in a cassette, and the radiographic film was exposed to X-rays at a voltage of 80 KVp through a water phantom (thickness: 10 cm) and an aluminum plate (thickness: 10 mm) at the density of 1.2. The radiographic film was then developed using a developing solution (RDIII, available from the same) by an automatic developing machine (New RN, manufactured by the same) for 90 sec. at 35° C., to obtain a visible image on the film. The film was measured to determine the RMS value by the use of a microphotometer (aperture: 300 μm×300 μm).

The results of the evaluations are set forth in Table 1.

TABLE 1

| | Example 1 | Com. Example 1 |
|---|---|---|
| Antistatic properties | A | C |
| Relative speed | 240 | 235 |
| Sharpness (%) | 38.6 | 39.7 |
| Graininess | $1.36 \times 10^{-2}$ | $1.38 \times 10^{-2}$ |

As is evident from the results set forth in Table 1, the radiographic intensifying screen provided with a metal film on the protective film (Example 1) gave no static mark on the visible image, and showed prominently improved antistatic properties.

Further, the radiographic intensifying screen of the invention was excellent in the graininess of an image provided thereby and showed the same level of the radiographic speed, although the sharpness somewhat lowered, as compared with the conventional screen provided with a colored adhesive layer for enhancement of the image quality (Comparison Example 1).

Accordingly, the radiographic intensifying screen of the invention was prominently improved not only in the antistatic properties but also in the image quality and radiographic speed.

We claim:

1. A radiographic intensifying screen comprising a support, a phosphor layer which comprises a binder and a phosphor dispersed therein and a protective film, superposed in order, wherein a deposited metal film is provided on one or both surfaces of said protective film, said deposited metal film having a light transmittance ranging from 10% to 90% at the peak wavelength of the emission of the phosphor and a thickness ranging from 10 to 1000 angstroms whereby the surface of the screen is essentially prevented from being electrostatically charged.

2. The radiographic intensifying screen as claimed in claim 1, wherein said deposited metal film is comprises at least one metal selected from the group consisting of Ni, Cr, Au, Sn, Al, Cu and Zn.

3. The radiographic intensifying screen as claimed in claim 1, wherein said deposited metal film has a surface resistivity of not more than $10^{12}$ ohm.

4. The radiographic intensifying screen as claimed in claim 1, wherein said deposited metal film has a surface resistivity of not more than $10^{8}$ ohm.

5. The radiographic intensifying screen as claimed in claim 1, wherein said deposited metal film is provided on only the phosphor layer side-surface of the protective film.

6. The radiographic intensifying screen as claimed in claim 1, wherein said deposited metal film has a light transmittance ranging from 30 to 90% at the peak wavelength of the emission of the phosphor.

7. The radiographic intensifying screen as claimed in claim 1, wherein said deposited metal film has a thickness ranging from 50 to 500 angstroms.

* * * * *